US009294844B2

(12) United States Patent
Kono

(10) Patent No.: US 9,294,844 B2
(45) Date of Patent: Mar. 22, 2016

(54) VOICE COIL SPEAKER

(71) Applicant: CLARION CO., LTD, Saitama (JP)

(72) Inventor: Kenji Kono, Saitama (JP)

(73) Assignee: CLARION CO., LTD, Saitama (JP)

( * ) Notice: Subject to any disclaimer, the term of this patent is extended or adjusted under 35 U.S.C. 154(b) by 0 days.

(21) Appl. No.: 14/402,656

(22) PCT Filed: May 14, 2013

(86) PCT No.: PCT/JP2013/063359

§ 371 (c)(1),
(2) Date: Nov. 20, 2014

(87) PCT Pub. No.: WO2013/175995

PCT Pub. Date: Nov. 28, 2013

(65) Prior Publication Data

US 2015/0156590 A1 Jun. 4, 2015

(30) Foreign Application Priority Data

May 21, 2012 (JP) ..... 2012-115414

(51) Int. Cl.

| | |
|---|---|
| ***H04R 9/00*** | (2006.01) |
| ***H04R 9/04*** | (2006.01) |
| ***H04R 1/06*** | (2006.01) |
| ***H04R 9/06*** | (2006.01) |

(52) U.S. Cl.

CPC .. *H04R 9/04* (2013.01); *H04R 1/06* (2013.01); *H04R 9/06* (2013.01); *H04R 2209/041* (2013.01); *H04R 2499/13* (2013.01)

(58) Field of Classification Search

CPC ..... H04R 1/02; H04R 1/025; H04R 1/026; H04R 9/00; H04R 29/003; H04R 2209/00; H04R 2209/41

USPC ..... 381/386, 388, 394, 409–410, 433, 398

See application file for complete search history.

(56) References Cited

U.S. PATENT DOCUMENTS

| | | | | |
|---|---|---|---|---|
| 2,903,516 | A * | 9/1959 | Biedermann et al. | 381/394 |
| 4,918,738 | A * | 4/1990 | Bader | 381/391 |
| 8,081,790 | B2 * | 12/2011 | Lin | 381/386 |

(Continued)

FOREIGN PATENT DOCUMENTS

| | | | |
|---|---|---|---|
| JP | 2004-320407 | A | 11/2004 |
| JP | 2005-129991 | A | 5/2005 |

(Continued)

OTHER PUBLICATIONS

International Search report issued in Application No. PCT/JP2013/064113 dated Aug. 13, 2013.

(Continued)

*Primary Examiner* — Suhan Ni

(74) *Attorney, Agent, or Firm* — McDermott Will & Emery LLP

(57) ABSTRACT

A signal processing board for outputting a driving signal to voice coils is disposed at a proper position. A voice coil speaker has a speaker frame, a diaphragm supported by the speaker frame, a bobbin which is connected to the diaphragm and has voice coils formed thereon, and a signal processing board for processing a driving signal to be output to the voice coil. The signal processing board is secured to the speaker frame while disposed at the outside of the diaphragm.

12 Claims, 4 Drawing Sheets

(56) References Cited

U.S. PATENT DOCUMENTS

| | | | | |
|---|---|---|---|---|
| 2005/0244028 | A1* | 11/2005 | Klein et al. | 381/396 |
| 2009/0262972 | A1 | 10/2009 | Yuasa | |

FOREIGN PATENT DOCUMENTS

| | | | |
|---|---|---|---|
| JP | 2005-333304 | A | 12/2005 |
| JP | 2010-028785 | A | 2/2010 |
| JP | 2011-223288 | A | 11/2011 |
| JP | 2011-223290 | A | 11/2011 |

OTHER PUBLICATIONS

English translation of International Preliminary Report on Patentability (Chapter 1) issued in International Application No. PCT/JP2013/063359 dated Dec. 4, 2014.

Japanese Office Action issued in corresponding Japanese Patent Application No. 2014-516758, mailed on Mar. 24, 2015; 6 pages with English translation.

Extended European Search Report issued in corresponding European Patent Application No. 13793735.5, mailed on Oct. 20, 2015.

* cited by examiner

VOICE COIL SPEAKER

CROSS-REFERENCE TO RELATED APPLICATION

The present application is a U.S. National Phase of PCT/JP2013/063359 filed May 14, 2013,which claims priority to Japanese Patent Application No. 2012-115414 filed May 21, 2012. The disclosures of the above applications are incorporated hereby in reference.

FIELD OF THE INVENTION

The present invention relates to a voice coil speaker having a signal processing board.

BACKGROUND ART

A speaker (digital speaker) having a bobbin in which multilayered voice coils are formed has been hitherto proposed (see Patent Document, for example). This type of speaker has a signal processing board, executes various kinds of signal processing in the signal processing board and outputs a driving signal from the signal processing board to the voice coils.

PRIOR ART DOCUMENT

Patent Document

Patent Document 1: JP-A-2010-28785

SUMMARY OF THE INVENTION

Problem to be Solved by the Invention

Here, with respect to a speaker having a signal processing board for outputting a driving signal to voice coils as in the case of the above described speaker, it has been needed that the signal processing board is disposed at a proper position.

The present invention has been performed in view of the above situation, and has an object to provide a voice coil speaker in which a signal processing board is disposed at a proper position.

Means of Solving the Problem

In order to attain the above object, a voice coil speaker comprises: a frame; a diaphragm supported by the frame; a bobbin that is connected to the diaphragm and has voice coils formed thereon; and a signal processing board for processing a driving signal to be output to the voice coils, wherein the signal processing board is disposed at the outside of the diaphragm and secured to the frame.

According to the present invention, a bracket secured to the frame is provided, and the signal processing board is supported by the bracket and secured to the frame while disposed at the outside of the diaphragm.

According to the present invention, the signal processing board is mounted in a board mount box provided to the bracket, and the board mount box is configured so that the front end thereof does not protrude forwards beyond the front end of the frame.

According to the present invention, a fixing position of the bracket to the frame is changeable.

According to the present invention, a gasket which is formed along the outer edge of the diaphragm and covers the frame is provided, and the bracket is constructed integrally with the gasket.

According to the present invention, the gasket is a circular member corresponding to the shape of the outer edge of the diaphragm, and a relative position of the bracket constructed integrally with the gasket to the frame is changeable by rotating the gasket.

According to the present invention, the voice coils are formed as multilayered voice coils on the bobbin, the voice coil speaker is provided with a bridge through which a signal line of the signal processing board corresponding to the multilayered voice coils is made to extend to a position corresponding to a front side of the voice coils, and the bridge is constructed integrally with the bracket.

According to the present invention, an extension portion that extends outwards from the frame and supports the signal processing board is provided, the extension portion and the bridge are constructed to extend on a straight line, and the signal line extends along the extension portion and the bridge to a position corresponding to a front side of the voice coils.

According to the present invention, terminals to which tinsel wires conducted to the respective multilayered voice coils are connected are provided at a position corresponding to a front side of the voice coils at the bridge so as to be spaced from one another at intervals in the peripheral direction.

According to the present invention, the respective terminals are provided at regular intervals in the peripheral direction.

According to the present invention, the signal processing board is provided with an amplification circuit.

This specification contains the whole content of Japanese Patent Application No. 2012-115414 filed on May 21, 2012.

Effect of the Invention

According to the present invention, the signal processing board for outputting the driving signal to the voice coils can be disposed at a proper position.

MODES FOR CARRYING OUT THE INVENTION

Embodiments according to the present invention will be described hereunder with reference to the drawings.

<First Embodiment>

Figure 1:
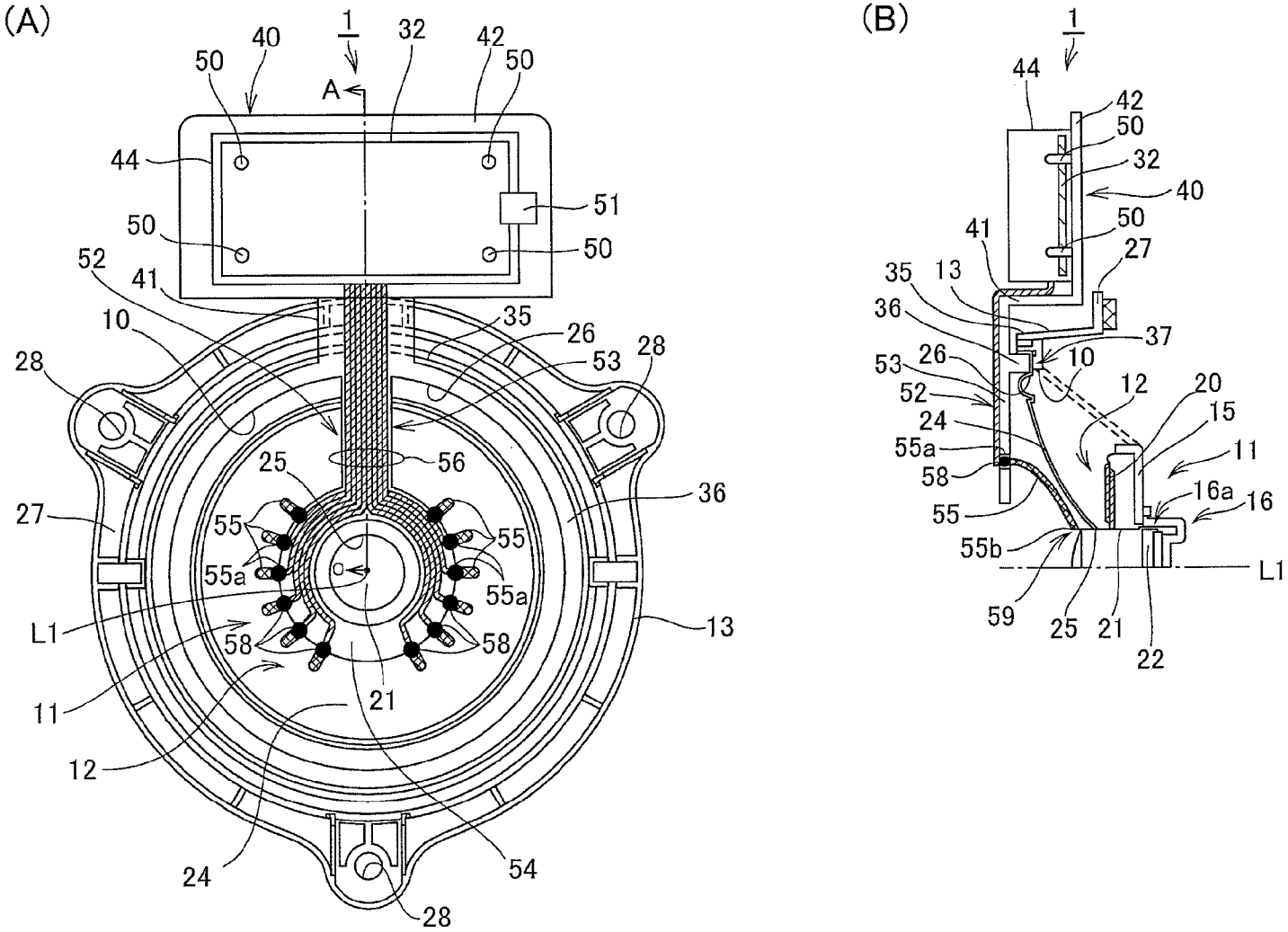
FIG. 1 is a diagram showing the construction of a voice coil speaker according to a first embodiment.

FIG. 1 is a diagram showing a voice coil speaker 1 according to an embodiment, wherein FIG. 1(A) is a front view, and FIG. 1(B) is a cross-sectional view of A-O of FIG. 1(A).

The voice coil speaker 1 according to this embodiment is a speaker which is assumed to be secured to a side door of a vehicle. When it is used, an audio signal is input from an in-vehicle mount audio device mounted in a vehicle to the voice coil speaker 1, and the audio signal is subjected to signal processing by a means described later to output sounds.

As shown in FIG. 1, the voice coil speaker 1 has a circular speaker opening 10 formed at the front surface thereof, and a speaker frame 13 (frame) in which a speaker main body mount portion 12 serving as a space for accommodating a speaker main body 11 therein is formed. In FIG. 1, the center axis of the voice coil speaker is represented by reference character L1.

A bowl-shaped frame rear portion 15 having a circular opening at the front surface thereof is formed at a rear portion of the speaker frame 13, and a magnetic circuit portion 16 (FIG. 1(B)) serving to drive the speaker main body 11 is provided at the rear side of the frame rear portion 15. A magnetic gap 16*a* is formed in the magnetic circuit portion 16, and a bobbin 21 and voice coils 22 formed by winding tinsel wires around the bobbin 21 are arranged in the magnetic gap 16*a*.

A damper 20 (FIG. 1(B)) is connected to the edge of the circular opening formed at the front surface of the frame rear portion 15 so as to block the opening. The cylindrical bobbin 21 extending in the same axial direction as the center axis L1 of the voice coil speaker 1 is supported at the center of the damper 20, whereby the bobbin 21 is supported and fixed to the speaker frame 13.

Figure 2:
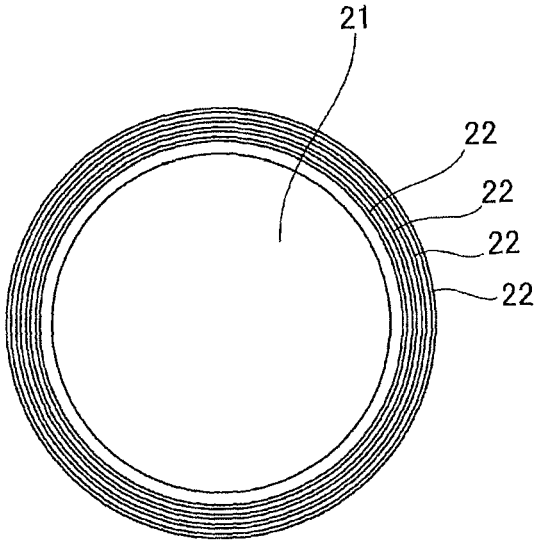
FIG. 2 is a diagram showing an example of multilayered voice coils.

FIG. 2 is a top view of the bobbin 21. In FIG. 2, in order to clarify the relationship between the bobbin 21 and the voice coils 22, the bobbin 21 and the voice coils 22 are schematically illustrated while the shapes of the bobbin 21 and the voice coils 22 are simplified.

As shown in FIG. 2, the bobbin 21 holds plural voice coils 22 formed by regularly winding tinsel wires formed of wire rods such as copper wires or the like in the axial direction of the bobbin 21. In this embodiment, the plural voice coils 22 are provided in piles to be multilayered in the peripheral direction of the bobbin 21. Each of the voice coils 22 of the respective layers is electrically connected to a tinsel wire 55 described later, and each voice coil 22 of each layer is configured to vibrate the bobbin 21 on the basis of a driving signal input from the tinsel wire 55.

Figure 3:
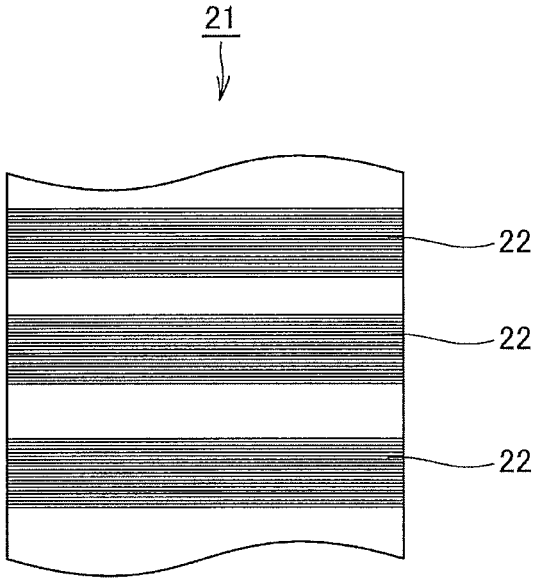
FIG. 3 is a diagram showing an example of the multilayered voice coils.

FIG. 3 is a view of a bobbin 21 of another example which is viewed from a lateral side. In FIG. 3, in order to clarify the relationship between the bobbin 21 and the voice coils 2, the bobbin 21 and the voice coils 22 are schematically illustrated while the shapes thereof are simplified as in the case of FIG. 2.

As shown in FIG. 3, the bobbin 21 holds multilayered voice coils 22 formed by winding and multiplexing tinsel wires formed of wire rods such as copper wires or the like. In this example, the plural voice coils 22 are formed so that the respective layers of the voice coils 22 are spaced from one another in the axial direction of the bobbin 21 (=the axial direction of the center axis L1 of the voice coil speaker 1). Each tinsel wire 55 described later is electrically connected to each voice coil 22 of each layer, and each voice coil 22 of each layer formed on the bobbin 21 vibrates the bobbin 21 on the basis of a driving signal associated with a sound to be output.

A base end portion 25 of a conical diaphragm 24 which increases in diameter as it goes to the front side is connected to the bobbin 21. The outer periphery of the tip portion 26 of the diaphragm. 24 is connected to the inner periphery of the speaker opening 10 formed at the front surface of the speaker frame 13. The diaphragm 24 vibrates in accordance with vibration of the bobbin 21 which is caused by the multilayered voice coils 22, and sounds are output on the basis of the vibration of the diaphragm 24.

An annular frame flange 27 extending outwards along the peripheral direction of the speaker opening 10 formed at the front surface of the speaker frame 13 is provided at a place which is on the outer periphery of the speaker opening 10 formed at the front surface of the speaker frame 13 and lowered from the speaker opening 10 by one step, and plural screw holes (FIG. 1(A)) are formed in the frame flange 27. When the voice coil speaker 1 is fixed to the side surface of a vehicle door, the voice coil speaker 1 is screwed at a predetermined position of the door through these screw holes 28.

As described above, the voice coil speaker 1 according to this embodiment outputs a driving signal to each of the multilayered voice coils 22 formed on the bobbin 21 to drive the bobbin 21 and output sounds. In this embodiment, various kinds of circuits for processing the driving signal, for example, am amplification circuit, a $\Delta\Sigma$ modulation circuit, various kinds of filter circuits, a network circuit, etc. are mounted on the same signal processing board 32 to perform concentration and uniform management of the various kinds of circuits, thereby enhancing the efficiency of the signal processing, reducing the influence of noises, facilitating the manufacturing of the circuit itself, reduction of the cost of the circuit, facilitating the manufacturing of the speaker, and reduction of the cost of the speaker.

Furthermore, in the voice coil speaker 1 according to this embodiment, the various kinds of circuits for processing the driving signal are mounted on the signal processing board 32, and thus it has a characteristic that the size of the board itself is relatively large. Particularly, the voice coil speaker 1 according to this embodiment has an amplification circuit mounted on the signal processing board 32 because it has a speaker structure that a driving signal is output to each of the multilayered voice coils 22 to output sounds. As publicly known, the amplification circuit is a relatively large circuit, and thus the signal processing board 32 having the amplification circuit mounted thereon is necessarily increased in size.

Furthermore, in order to prevent the voice coil 22 from being adversely affected by some noise until the driving signal output from the signal processing board 32 is input to the voice coil 22, the voice coil 22 of this embodiment has a characteristic that it is necessary to make the interval distance between the signal processing board 32 and the voice coil 22 as short as possible, thereby shortening the physical length of a signal line through which the board and the coil are conducted to each other.

Still furthermore, in this embodiment, plural tinsel wires 55 (described later) exist because the voice coils 22 are multilayered. From the viewpoint that the sound quality of the voice speaker 1 is maintained while the interference among these plural tinsel wires 55 is prevented, it is necessary to dispose the tinsel wires 55 at a proper position.

In consideration of the above matter, the voice coil speaker 1 according to this embodiment has the following construction.

As shown in FIG. 1, in the speaker frame 13, a frame outer frame portion 35 which is formed to surround the outer edge of the tip portion 26 of the diaphragm 24 and project forwards is provided at the position corresponding to the outside of the outer edge of the tip portion 26 of the diaphragm 24. A gasket 36 which is formed of resin and covers the speaker frame 13 is provided at a gap portion 37 (FIG. 1(B)) corresponding to the gap between the outer edge of the tip portion 26 of the diaphragm 24 and the frame outer frame portion 35.

This gasket 36 is an existing member which covers the tip portion 26 of the diaphragm 24, that is, the connection portion between the diaphragm 24 and the speaker frame 13, thereby having a function of protecting the connection portion, and prevents the connection portion from being exposed to the outside, thereby having a function of enhancing the design characteristic of the speaker frame 13. The gasket 36 is a resin member, and fixed to the gap portion 37 by adhesion.

In this embodiment, a bracket 40 for supporting the signal processing board 32 is provided integrally with the gasket 36.

The bracket 40 is the same member as the gasket 36, and formed integrally with the gasket 36 by resin molding. The bracket 40 and the gasket 36 are formed of the same member as described above. However, for convenience of description, a site associated with the function of protecting the connection portion of the diaphragm 24 is represented as the gasket 36, and a site associated with the function of supporting the signal processing board 32 is represented as the bracket 40.

The construction of the bracket 40 will be described in detail. As shown in FIG. 1, an extension portion 41 having a predetermined width extends from a predetermined position of the gasket 36 outwards in the peripheral direction. After the extension portion 41 extends outwards in the peripheral direction by a predetermined distance, the extension portion 41 substantially orthogonally bends to the rear side, and extends to the rear side by a predetermined distance. A board fixing portion 42 is connected to the end portion of the extension portion 41.

The board fixing portion 42 is a plate-like member to which the signal processing board 32 is secured and fixed, and extends along the peripheral direction of the speaker frame 13. As shown in FIG. 1, the board fixing portion 42 is set to be located at the outside of the tip portion 26 of the diaphragm 24 in the peripheral direction.

A box-shaped board mount box 44 is secured to the board fixing portion 42. The signal processing board 32 is fixed to the board fixing portion 42 through a support member 50 in the board mount box 44. The shape of the board fixing portion 42 is rectangular in front view so as to correspond to the shape of the signal processing board 32.

Reference numeral 51 represents a connector to which a cable from the in-vehicle mount audio device is connected.

As described above, the voice coil speaker 1 according to this embodiment has the bracket 40 formed integrally with the gasket 36, and the signal processing board 32 is fixed to the speaker frame 13 at the outside of the tip portion 26 of the diaphragm 24 by the function of the bracket 40. Accordingly, the following effect can be obtained.

That is, since the signal processing board 32 is not provided in the speaker main body 11, it is unnecessary to change the construction of the speaker main body 11 itself in accordance with the arrangement of the signal processing board 32, and also it is unnecessary to design the signal processing board 32 as a dedicated article having a peculiar shape corresponding to the structure of the speaker main body 11 and further mount circuits on the board in conformity with the peculiar shape. Therefore, structural change of the existing speaker main body 11 and speaker frame 13 is restrictive, facilitation of the manufacturing can be enhanced, and the manufacturing cost can be reduced. Furthermore, when the speaker main body 11 and the speaker frame 13 are designed, it is unnecessary to consider the signal processing board 32. Therefore, the degree of freedom for design of these parts can be enhanced.

Furthermore, the board fixing portion 42 of the bracket 40 is a part which is independent of the speaker frame 13 and the speaker main body 11. Therefore, it does not have any influence on the structures of the speaker frame 13 and speaker main body 11, and the size and shape of the board fixing portion 42 can be adapted to the shape and size of the signal processing board 32. Accordingly, the board fixing portion 42 can be properly adapted to the characteristic that the signal processing board 32 is relatively large.

Furthermore, the signal processing board 32 can be fixed to the board fixing portion 42 of the bracket 40 which is fixed to the speaker frame 13 in proximity to the speaker frame 13. Therefore, the signal processing board 32 and the voice coil 22 can be prevented from being needlessly far away from each other, and the influence of noises on the signal line through which the signal processing board 32 and the voice coil 22 are electrically connected to each other can be effectively suppressed.

Furthermore, the bracket 40 is disposed at the outside of the tip portion 26 of the diaphragm 24, and is not located ahead of the diaphragm 24. Therefore, sounds generated by vibration of the diaphragm 24 can be surely prevented from being adversely affected by the bracket 40.

Furthermore, in the voice coil speaker 1 according to this embodiment, the gasket 36 and the bracket 40 for fixing the signal processing board 32 are configured integrally with each other. Accordingly, the following effect can be attained.

That is, the gasket 36 is the member which is firmly fixed to the gap portion 37 (FIG. 1(B)) as the gap between the outer edge of the tip portion 26 of the diaphragm 24 and the frame outer frame portion 35 by adhesion. Accordingly, by constructing the gasket 36 and the bracket 40 integrally with each other, the bracket 40 can be firmly fixed to the speaker frame 13 with an existing member.

Furthermore, the gasket 36 is a member independent of the speaker frame 13, and when it is fixed to the speaker frame 13, it is adhesively fixed. Accordingly, it is unnecessary that a dedicated fixing structure is formed in the speaker frame 13 to fix the bracket 40 to the speaker frame 13, and the facilitation of the manufacturing can be enhanced.

Still furthermore, the gasket 36 is a circular member whose shape corresponds to the shape of the gap portion 37, and it is arbitrarily rotatable around the center axis L1 relatively to the gap portion 37 before adhesion. That is, in this embodiment, the relative position of the bracket 40 to the speaker frame 13 can be moved by rotating the gasket 36 around the center axis L1, and the bracket 40 can be disposed at any position in the peripheral direction. That is, the gasket 36 is the circular member corresponding to the shape of the outer edge of the diaphragm 24, and the position of the bracket 40 which is constructed integrally with the gasket 36 can be moved relatively to the speaker frame 13 by rotating the gasket 36. Therefore, the relative position of the bracket 40 to the speaker frame 13 can be changed to the optimum position in accordance with the shape of a place where the voice coil speaker 1 is secured, the condition of other members at that place, and the environment at the place where the speaker is secured. Particularly, the voice coil speaker 1 according to this embodiment is a speaker which is assumed to be secured to the side door of the vehicle. The shape of the side door varies in accordance with the type of the vehicle, and the environment at a position of the side door where the voice speaker 1 is secured (the condition of members around the position concerned, the condition of the space, etc.) is different. Accordingly, it is strongly required that the bracket 40 can be positionally changed with respect to the speaker frame 13 and thus the bracket 40 can be disposed at the optimum position corresponding to the environment or the condition. The present invention is properly adaptable to this requirement.

Furthermore, in this embodiment, as shown in FIG. 1(B), the extension portion 41 has the shape corresponding to the shape of the outer periphery of the speaker frame 13. Therefore, the signal processing board 32 provided to the board fixing portion 42 is prevented from being needlessly far away from the speaker main body 11 and the voice coils 22.

Still furthermore, the extension portion 41 has a portion which extends to the rear side by only a predetermined distance. Therefore, as shown in FIG. 1(B), the board mount box 44 secured to the board fixing portion 42 is prevented from protruding forwards beyond the front end of the speaker frame 13. That is, the signal processing board 32 is mounted in the board mount box 44 provided to the bracket 40, and the front end of the board mount box 44 is configured not to protrude forward beyond the front end of the speaker frame 13. Therefore, it can be prevented that the board mount box 44 protrudes when the voice coil speaker 1 is secured to the side door of the vehicle and thus the voice coil speaker 1 has a bad appearance.

As shown in FIG. 1, a bridge 52 is provided at the position corresponding to the extension portion 41 on the inner periphery of the gasket 36.

The bridge 52 is a member which is constructed integrally with the gasket 36, and has a bridge portion 53 extending to the center axis L1, and a ring-shaped terminal forming portion 54 formed at the tip of the bridge portion 53. That is, in this embodiment, the gasket 36, the bracket 40 and the bridge 52 are integrally formed of resin. As shown in FIG. 1(A), the extension portion 41 of the bracket 40 and the bridge portion 53 of the bridge 52 are provided on the same straight line.

As shown in FIG. 1(A), the terminal forming portion 54 is the ring-shaped member with the center axis L1 located at the center, and disposed at the position corresponding to the front side of the bobbin 21 (voice coils 22). Twelve terminals 58 are formed on the outer periphery of the terminal forming portion 54. More specifically, six terminals 58 which are connected to six signal transmission cords 56 (described later) are formed and arranged at regular intervals at the right side of the terminal forming portion 54 in FIG. 1(A), and likewise six terminals 58 which are connected to six signal transmission cords 56 are formed and arranged at regular intervals at the left side of the terminal forming portion 54.

The electrical connection between the signal processing board 32 and the voice coils 22 and the construction of the signal line for the driving signal to be output from the signal processing board 32 to the voice coils 22 are as follows. In this embodiment, six layers of voice coils 22 are formed on the bobbin 21, and two signal lines which are conducted to the signal processing board are connected to each of the six layers of voice coils 22.

That is, twelve signal transmission cords 56 are lead out as the signal line from the signal processing board 32. These twelve cords extend along the extension portion 41, further extend along the bridge portion 53 of the bridge 52 and reach the terminal forming portion 54. At the extension portion 41 and the bridge portion 53, each cord is fixed to these members by a means such as adhesion or the like.

Each of the signal transmission cords 56 extending to the terminal forming portion 54 is connected to the corresponding terminal 58 at the terminal forming portion 54, whereby the electrical connection between the signal processing board 32 and each of the terminals 58 is established.

Furthermore, one end 55*a* of each of the twelve tinsel wires 55 is connected to each terminal 58 formed at the terminal forming portion 54, and the other end 55*b* of each of the twelve tinsel wires 55 is connected to the connection portion 59 formed at the front end portion of the bobbin 21. A conductive member (for example, thin film of metal) through which the other ends 55*b* of the tinsel wires 55 connected to the connection portion 59 are electrically connected to the corresponding voice coils 22 is formed on the surface of the bobbin 21, thereby establishing the electrical connection between each of the terminals 58 formed at the terminal forming portion 54 and each of the voice coils 22.

Here, the bobbin 21 is a member which vibrates while accompanying an output of sounds, and thus the tinsel wires 55 connected to the connection portion 59 of the bobbin 21 must be provided with flexure portions (backlash portions) in consideration of the stroke amount of the bobbin 21. On the other hand, as the distance between one end 55*a* and the other end 55*b* of the tinsel wire 55 is longer, that is, the length of the tinsel wire 55 increases, the flexure portions of the tinsel wires 55 are larger, which increases the probability that the tinsel wires interfere with one another.

In consideration of this matter, according to this embodiment, the terminal forming portion 54 at which the terminals 58 connected to the one ends 55*a* of the tinsel wires 55 are formed is disposed at a position corresponding to the front side of the bobbin 21 by the function of the bridge 52. Therefore, the distance between the one end 55*a* and the other end 55*b* of the tinsel wire can be made as short as possible to thereby reduce the length of the tinsel wire 55, and also the flexure portion provided to the tinsel wire 55 can be made small, whereby the interference among the tinsel wires 55 can be effectively prevented.

Furthermore, the terminals 58 are arranged at substantially regular intervals at the terminal forming portion 54. Accordingly, the physical interval distance among the tinsel wires 55 can be secured most efficiently, and the interference of the tinsel wires 55 can be more effectively prevented.

Still furthermore, the terminal forming portion 54 is disposed ahead of the bobbin 21, and the bobbin 21 and the terminal forming portion 54 are arranged on the same axis by the function of the bridge 52, so that the respective tinsel wires 55 extending from the terminals 58 of the terminal forming portion 54 to the bobbin 21 are uniform in length, and thus it can be prevented that non-uniform force is applied to the bobbin 21 through the tinsel wires 55 and the sound quality degrades.

Furthermore, as described above, the bridge 52, the gasket 36 and the bracket 40 are constructed integrally with one another. Accordingly, the following effect can be obtained.

That is, in this embodiment, as shown in FIG. 1, the extension portion 41 of the bracket 40 and the bridge portion 53 of the bridge 52 are configured to extend on the same straight line. That is, the voice coil speaker 1 has the extension portion 41 which extends outwards from the speaker frame 13 and supports the signal processing board 32, the extension portion 41 and the bridge 52 are configured to extend on the straight line, and the signal transmission cords 56 (signal line) extends along the extension portion 41 and the bridge 52 to the position corresponding to the front side of the voice coils 22. Therefore, the respective signal transmission cords 56 extending from the signal processing board 32 linearly extend to the terminal forming portion 54, so that the lengths of these cords may be short and thus the effect of noise can be reduced.

Furthermore, as described above, the position of the bracket 40 with respect to the speaker frame 13 can be set to any position on the concentric circle before adhesion of the gasket 36. However, the gasket 36 and the bridge 52 are constructed integrally with each other, and thus the positional relationship between the bracket 40 and the bridge 52 is invariable irrespective of the position of the bracket 40. Accordingly, it is unnecessary to adjust the position of the bridge 52 in accordance with the position of the bracket 40, and the manufacturing is easily performed. When the position of the bracket 40 is moved by rotating the gasket 36, it is necessary to rotate the bobbin 21 in accordance with the rotation of the gasket 36.

As described above, the voice coil speaker 1 according to this embodiment has the speaker frame 13 (frame), the diaphragm 24 supported by the speaker frame 13, the bobbin 21 which is connected to the diaphragm 24 and has the voice coils 22 formed thereon, and the signal processing board 32 for processing driving signals output from the voice coils 22.

In the voice coil speaker 1, the signal processing board 32 is secured to the speaker frame 13 while disposed at the outside of the diaphragm 24.

Accordingly, the signal processing board 32 having a relatively large size can be disposed in proximity to the voice coils 22 without modifying the structures of the speaker main body 11 and the speaker frame 13 and also without adversely affecting output sounds, and also the various kinds of circuits for processing the driving signal are mounted on the signal processing board 32. Therefore, the signal processing board 32 can be disposed at a proper position in consideration of the characteristic that the size of the board itself is relatively large and also the characteristic that it is necessary to make the interval distance between the signal processing board 32 and the voice coil 22 as short as possible.

Furthermore, the voice coil speaker 1 according to this embodiment has the bracket 40 secured to the speaker frame 13. The signal processing board 32 is supported by the bracket 40, and secured to the speaker frame 13 while disposed at the outside of the diaphragm 24.

According to this construction, the signal processing board 32 can be fixed to the speaker frame 13 through the bracket 40 which is an member independent of the speaker frame 13. Therefore, the signal processing board 32 can be disposed at a proper position while suppressing structural modification of the speaker frame 13 in consideration of the characteristic that the board itself is relatively large in size and the characteristic that it is necessary to make the interval distance between the signal processing board 32 and the voice coil 22 as short as possible.

Furthermore, the voice coil speaker 1 according to this embodiment is configured so that the fixing position of the bracket 40 to the speaker frame 13 can be changed.

According to this construction, the position of the bracket 40 can be changed in accordance with the condition at the position where the voice coil speaker 1 is secured. Therefore, the speaker can be secured under various environments, which can enhance an appeal as an article.

Still furthermore, the voice coil speaker 1 according to this embodiment has the gasket 36 which is formed along the outer edge of the diaphragm 24 so as to cover the speaker frame 13, and the bracket 40 and the gasket 36 are constructed integrally with each other.

According to this construction, the bracket 40 can be firmly fixed to the speaker frame 13 by using an existing member as a gasket 36, and also the relative position of the bracket 40 to the speaker frame 13 can be changed.

Still furthermore, according to the embodiment, the multilayered voice coils 22 are formed on the bobbin 21. The voice coil speaker 1 has the bridge 52 with which the signal line of the signal processing board 32 which corresponds to the multilayered voice coils 22 is made to extend to the position corresponding to the front side of the voice coils 22, and the bridge 52 is constructed integrally with the bracket 40.

According to this construction, the position of the bracket 40 with respect to the speaker frame 13 can be disposed at any position on the concentric circle before adhesion of the gasket 36. However, since the gasket 36 and the bridge 52 are constructed integrally with each other, the positional relationship between the bracket 40 and the bridge 52 is invariable irrespective of the position of the bracket 40. Accordingly, it is unnecessary to adjust the position of the bridge 52 in accordance with the position of the bracket 40, and thus the manufacturing can be easily performed.

Furthermore, according to this embodiment, the terminals 58 to which the tinsel wires 55 are connected are provided to be spaced from one another at a substantially fixed interval in the peripheral direction at the terminal forming portion 54 of the bridge 52.

According to this construction, the physical interval distance of the respective tinsel wires 55 can be secured most efficiently, and the interference of the tinsel wires 55 can be effectively prevented.

<Second Embodiment>

Next, a second embodiment will be described.

In the following description, members having the same functions as the voice coil speaker 1 according to the first embodiment are represented by the same reference numerals, and the detailed description thereof is omitted.

Figure 4:
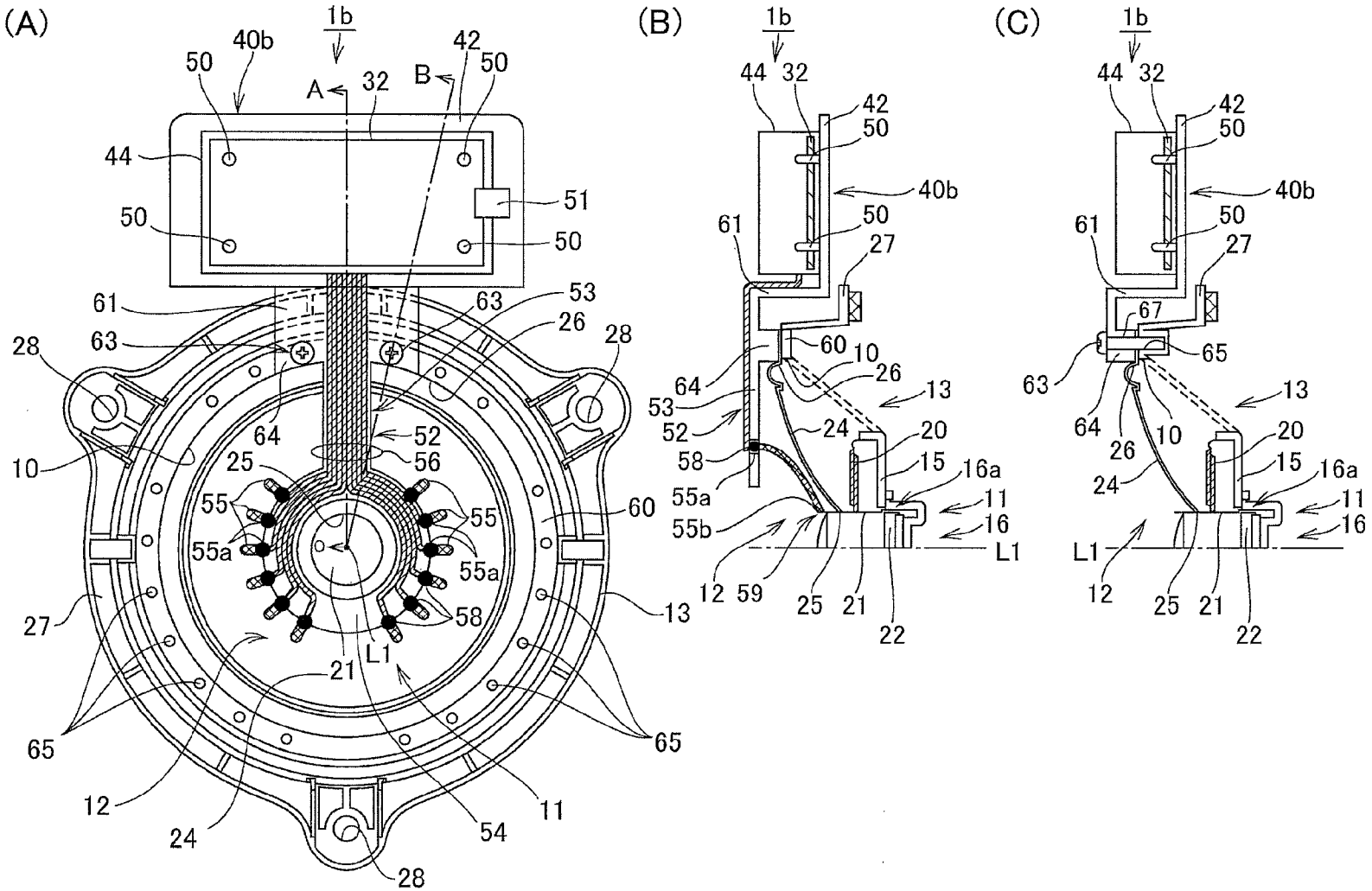
FIG. 4 is a diagram showing the construction of a voice coil speaker according to a second embodiment.

FIG. 4 is a diagram showing a voice coil speaker 1*b* according to a second embodiment, wherein FIG. 4(A) is a front view, FIG. 4(B) is a cross-sectional view of A-O of FIG. 4(A), and FIG. 4(C) is a cross-sectional view of B-O of FIG. 4(A).

In the first embodiment described above, the bracket 40 is constructed integrally with the gasket 36. On the other hand, the voice coil speaker 1*b* according to this embodiment does not have the gasket 36, and the bracket 4*b* is fixed to the speaker frame 13 in a manner different from that of the first embodiment.

Specifically, the bracket 40*b* has a fixing member 61 corresponding to the extension portion 41 of the first embodiment. The fixing member 61 is a member which is fixed to the speaker frame 13 and supports the board fixing portion 42 as in the case of the extension portion 41 of the first embodiment, and designed to be bent in L-shape along the outer periphery of the speaker frame 13.

A thick screw penetrating portion 64 having two through holes (FIG. 4(C)) through which screws 63 for fixing the fixing member 61 to the speaker frame 13 penetrate is formed at the base end portion of the fixing member 61. In the speaker frame 13, a screw fixing portion 60 which is formed so as to surround the tip portion 26 of the diaphragm 24 is formed at the outer edge of the tip portion 26 of the diaphragm 24, and screw holes 65 in which the screws are threadably fitted are formed in the screw fixing portion 60 so as to be spaced from one another at a predetermined interval.

Under the above construction, the bracket 40*b* is fixed to the speaker frame 13 through the fixing member 61 as follows.

That is, the two through holes 67*c* provided to the screw penetrating portion 64 of the fixing member 61 and two desired screw holes 65 formed in the screw fixing portion 60 are positioned to each other. Subsequently, the screws 63 are threadably fitted in the screw holes 65 through the two through holes 67 provided to the screw penetrating portion 64, whereby the fixing member 61 is fixed to the screw fixing portion 60. The fixing member 61 is fixed to the screw fixing portion 60 as described above, so that the position of the bracket 40*b* with respect to the speaker frame 13 can be changed by changing the corresponding relationship between the through hole 67 of the screw penetrating portion 64 of the fixing member 61 and the screw hole 65 of the screw fixing portion 60.

According to the above construction, the following effect can be achieved in addition to the effect of enabling the signal processing board 32 to be disposed at a proper position in consideration of the characteristic that the signal processing board 32 is relatively large and the characteristic that the interval di stance between the signal processing board 32 and the voice coil 22 is required to be short as in the case of the first embodiment.

That is, the gasket 36 is not an indispensable member in the speaker, and the bracket 40*b* can be firmly fixed to the speaker frame 13 for even a speaker having no gasket 36. Furthermore, in the construction that the bracket 40 is fixed through the gasket 36 as in the case of the first embodiment, once the bracket 40 is fixed to the speaker frame 13, the position of the bracket 40 cannot be subsequently easily changed because of the construction that the gasket is adhesively fixed. However, according to this embodiment, since the bracket 40*b* is fixed through the screws 63, the position of the bracket 40*b* with respect to the speaker frame 13 can be relatively easily changed.

The above embodiments are merely examples of the present invention, and any modification and application may be made without departing from the subject matter of the present invention.

For example, in the above embodiments, six layers of voice coils 22 are provided, but the number of the layers of the voice coils 22 is not limited to these embodiment. That is, the present invention is broadly applicable to a speaker having a board for outputting a driving signal to voice coils 22.

DESCRIPTION OF REFERENCE NUMERALS

1, 1*b* voice coil speaker
13 speaker frame (frame)
21 bobbin
22 voice coil
24 diaphragm
32 signal processing board
36 gasket
40, 40*b* bracket
52 bridge
53 bridge portion
54 terminal forming portion
55 tinsel wire
58 terminal

The invention claimed is:

1. A voice coil speaker comprising:

a frame having a speaker opening that is formed at a front surface of the frame;

a diaphragm having an outer periphery that is connected to an inner periphery of the speaker opening;

a bobbin that is connected to the diaphragm and has voice coils formed thereon;

a signal processing board that processes a driving signal to be output to the voice coils;

a gasket having a shape that corresponds to the outer periphery of the diaphragm and covering a connection portion between the outer periphery of the diaphragm and the inner periphery of the speaker opening, the gasket being a body separate from the frame; and a bracket having an end portion that is connected to the gasket at a predetermined position, extending from the end portion to an outside of the frame, and supporting the signal processing board at the outside of the diaphragm.

2. The voice coil speaker according to claim 1, wherein the bracket comprises a board fixing portion at the outside of the diaphragm, wherein the board fixing portion extends to the outside of the frame in parallel with the front surface of the frame, and the signal processing board is secured to the board fixing portion so that a surface of the signal processing board is in parallel with the front surface of the frame.

3. The voice coil speaker according to claim 1, wherein the signal processing board is mounted in a board mount box provided to the bracket, and the bracket supports the board mount box so that the front end of the board mount box does not protrude forwards beyond a front end of the frame.

4. The voice coil speaker according to claim 3, wherein the bracket comprises an extension portion that extends from a predetermined position of the gasket to the outside of the frame and bends to a rear side at a position beyond an edge of the frame, and a board fixing portion that is connected to an end portion of the extension portion, extends to the outside of the frame, and supports the board mount box so that the front end of the board mount box does not protrude forwards beyond the front end of the frame.

5. The voice coil speaker according to claim 1, wherein the voice coils are formed as multilayered voice coils on the bobbin, the voice coil speaker is provided with a bridge constructed integrally with the bracket and with the gasket as a same member, and through which the bridge, signal lines of the signal processing board corresponding to the multilayered voice coils is made to extend to a position corresponding to a front side of the voice coils.

6. The voice coil speaker according to claim 5, further comprising an extension portion that extends to the outside from the frame and supports the signal processing board, the extension portion and the bridge are constructed to extend on a straight line, and the signal lines extend linearly along the extension portion and the bridge to the position corresponding to the front side of the voice coils.

7. The voice coil speaker according to claim 5, wherein terminals to which the signal lines conducted to the respective multilayered voice coils are connected are provided at the position corresponding to the front side of the voice coils at the bridge so as to be spaced from one another at intervals.

8. The voice coil speaker according to claim 7, wherein the respective terminals are provided at regular intervals on a circumference of a circle having a center that is positioned on a center axis of the bobbin.

9. The voice coil speaker according to claim 1, wherein the signal processing board is provided with an amplification circuit.

10. The voice coil speaker according to claim 1, wherein the bracket is constructed integrally with the gasket as a same member.

11. The voice coil speaker according to claim 1, wherein the inner periphery of the speaker opening provided on the frame is in a circular shape, the outer periphery of the diaphragm is in a circular shape, and the gasket is a circular member having a shape that corresponds to the outer periphery of the diaphragm.

12. The voice coil speaker according to claim 11, wherein the bracket is a same member of the gasket, the gasket is rotated relatively to the frame so as to allow a relative position, to the frame, of the signal processing board supported by the bracket being a same member of the gasket to be changed, and the gasket is fixed to the frame so as to allow the relative position of the signal processing board to the frame to be fixed.

* * * * *